US007915509B2

(12) United States Patent
Stanwood

(10) Patent No.: US 7,915,509 B2
(45) Date of Patent: Mar. 29, 2011

(54) MOVABLE PIVOT BEARING FOR CHANGING KEY LEVERAGE IN STRING KEYBOARD INSTRUMENTS

(76) Inventor: David Stanwood, West Tisbury, MA (US)

( * ) Notice: Subject to any disclaimer, the term of this patent is extended or adjusted under 35 U.S.C. 154(b) by 0 days.

(21) Appl. No.: 12/592,585

(22) Filed: Nov. 30, 2009

(65) Prior Publication Data

US 2010/0132532 A1 Jun. 3, 2010

Related U.S. Application Data

(60) Provisional application No. 61/200,496, filed on Dec. 1, 2008.

(51) Int. Cl.
*G10D 13/02* (2006.01)

(52) U.S. Cl. ..... 84/423 R

(58) Field of Classification Search ..... 84/423 R, 84/430–433
See application file for complete search history.

(56) References Cited

U.S. PATENT DOCUMENTS

2006/0272469 A1* 12/2006 Meisel ..... 84/21
* cited by examiner

*Primary Examiner* — Kimberly R Lockett
(74) *Attorney, Agent, or Firm* — John M. Brandt

(57) ABSTRACT

A moveable key lever pivot bearing system for keyboard instruments in which the pivot bearing is provided with a longitudinal slot to enable mounting the bearing over a pivot pin disposed on a balance rail mounted within the case of the instrument. The key lever, pivot pin, and balance rail all remain in fixed relationship to one another resulting in a fulcrum point change when the bearing is longitudinally shifted back and forth with respect to the pianist. Means are provided to fix the bearing at a selected longitudinal position, extension arms for example, which may be manipulated to adjust the position of the bearings.

4 Claims, 10 Drawing Sheets

HEAVY TOUCH
FRONT KEY ARM
SHORTER

MEDIUM TOUCH

LIGHT TOUCH
FRONT KEY
ARM LONGER

MOVABLE PIVOT BEARING FOR CHANGING KEY LEVERAGE IN STRING KEYBOARD INSTRUMENTS

CROSS REFERENCE TO RELATED APPLICATIONS

This application is based on the disclosure of U.S. Provisional Application Ser. No. 61/200,496 by the same inventor, filed Dec. 1, 2008 which is hereby incorporated by reference.

BACKGROUND OF THE INVENTION

1. Field of the Invention

The invention relates to key mechanisms used in stringed keyboard instruments, primarily but not limited to pianos, and more particularly relates to apparatus for varying the touch or pressure required to strike a note.

2. Description of the Prior Art

The piano key mechanism is one of a grouping of key mechanisms typically numbering 88 used for propelling felt hammers onto strings thereby producing a tones and music. Piano key levers are depressed or struck by the fingers of the pianist and piano hammers are propelled at an amplified rate of speed onto the strings.

In the prior art of piano key mechanism design, the piano key rests on a pivot bearing which is in a fixed position on a balance rail and is held in place by a metal pivot pin inserted in the balance rail. The pivot bearing is typically a disc of felted wool cloth or a half round section of wood covered in wool felt which is also held in place by the pivot pin. On the rearward side of the key there is most often a metal screw with a smooth top that engages the mechanism for propelling the hammer into the string.

The rate of speed amplification between the finger and key moving down and the hammer moving up to the string is greatly influenced by the location of the balance or fulcrum point of the key lever on the pivot bearing. For any given balance point of a key lever, the closer the fulcrum point is to the pianist, the faster the hammer moves in relation to the key movement when the pianist strikes the key, and the more force that is required by the pianist to play the keys. Also because the hammer is moving more quickly, the downward distance that the key has to move in order for the internal workings of the mechanism to complete their function does not have to be as great. Conversely if the balance point of the key lever is designed to be farther away from the pianist, the hammer moves slower in relation to the key movement when the pianist strikes the key, and the less force is required by the pianist to play the keys. Also because the hammer is moving more slowly, the downward distance that the key has to move in order for the internal workings of the mechanism to complete their function has to be greater.

Pianists typically select a particular piano for the quality of touch or the amount of force required to depress the key when playing the piano. Some like a heavy touch, some like a medium touch, and some like a lighter touch. It all depends on the physiology of the pianist and the type of music they are playing. Pianists who require a lighter touch need a different piano from those who require a heavier touch.

The prior art discloses a number of unique systems in which a key lever fulcrum point is moved within a keyboard instrument to effect the playing characteristics of that instrument. U.S. Pat. No. 1,224,994, Anelli, shows an arrangement in which the key levers remain stationary and the entire balance rail assembly, including the pivot pins, and pivot bearings is longitudinally shifted as a unit with respect to the keys.

U.S. Pat. No. 777,133, Oleson, presents an adjustable secondary follow on fulcrum member for organ keys which is not constructed as part of the primary key fulcrum assembly using a balance rail and pivot pins.

U.S. Pat. No. 619,964, Kringle, illustrates a complex system using weights and a moveable fulcrum which is again a secondary rather than a primary device not directly interacting with a key lever.

U.S. Pat. No. 4,308,783, Absmann, provides for two spaced apart longitudinal pivot pin receiving slots in the key lever so that the lever may be disposed over one or the other of the stationary pivot pins on the balance rail.

Other relatively complicated approaches are disclosed in U.S. Pat. No. 4,381,691, Conklin Jr. et al., using springs; Japanese publication JP2005077848 (A), Ishikawa Akira, using weights; and International Publication Number WO00/54248, Snel et al., employing adjustable magnets.

None of the prior art devices known to applicant appear suitable for use in existing instruments. That is, they must be integrated into the initial construction of the instrument and would not be capable of easily, if at all, being retrofitted into instruments that have already been built. Further, there is no structure of any kind in the prior art which could be employed in applicant's manner even in newly constructed instruments.

Additionally, applicant's invention allows for a multiplicity of touch adjustments along all the keys of an entire keyboard as well as the means to vary the settings unequally, that is, to provide for a lighter touch in one group of keys and a heavier touch in another.

SUMMARY OF THE INVENTION

The invention may be summarized as a key lever pivot bearing assembly for changing the fulcrum points of key levers within instruments under construction or those already in existence.

It is the primary object of the present invention to create a range of touch within a single instrument by providing a mechanism which allows pivot bearings under the key levers to be moved longitudinally, that is, forwards or backwards with respect to the pianist, thereby influencing the playing quality of the piano. In the preferred embodiment of the invention, pivot bearings under each key lever are attached to slideable bearing arms which are in turn attached to an adjustable bearing rail under the front side of the key levers. Means for longitudinally moving the bearing rail are provided for by, for example, a threaded nut and bolt combination at one or more positions along the length of the keyboard. By rotating the bolts using turning knobs in appropriate locations along the keyboard, the pianist may thereby adjust the positions of the pivot bearings. Each knob may be turned more or less equally to provide a uniform reduction or increase in the playing force or unequally to skew the bearing rail to provide a varying playing force across the keyboard.

Each bearing arm is made of a material that allows for flat and thin flexible construction with omni-directional lateral strength. It must be stiff enough to withstand pushing and pulling the pivot bearings under the key levers. Such materials may include fiberglass or other materials using woven fiber construction impregnated with resin. The pivot bearings attached to the bearing arms have a slot of a width matching the diameter of the pivot pin that positions the key lever over the pivot bearing. The longitudinal length of the slot is long enough to allow the pivot bearings to slide back on forth over the balance rail. Paper discs, called punchings, may be slipped over the pivot pin and held in between the balance rail and the pivot bearings for the purpose of setting the height of the key lever on the playing end of the piano. These punchings are part of the normal construction of piano keyboards.

The assembly further includes bearing arms of a particular configuration to facilitate the construction and operation of the invention.

These, and other features and advantages of the invention will become more evident from the description of the preferred embodiment accompanied by the drawings which follows.

DESCRIPTION OF THE PREFERRED EMBODIMENTS

Figure 1A:
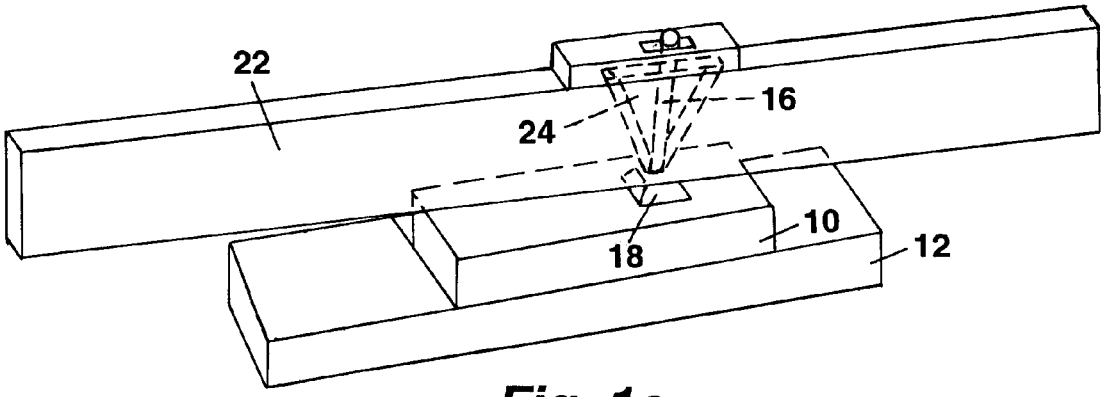
FIGS. 1*a*, 1*b*, and 1*c* are perspective views of the prior art relating to the invention.
Figure 1B:
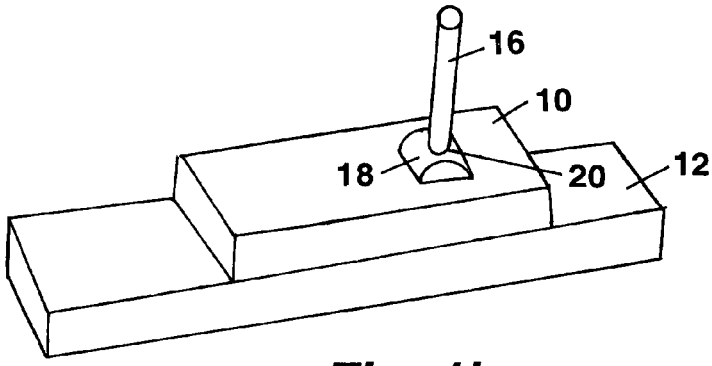
Figure 1C:
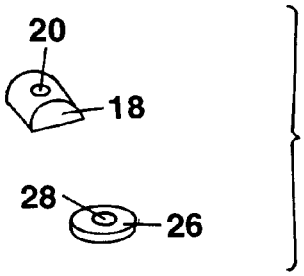

Referring first to FIGS. 1*a*, 1*b*, and 1*c*, perspective views of the present device used to fulcrum a key lever in a keyboard instrument, particularly a piano, are shown in which balance rail 10 is positioned atop support member or key frame 12 forming a part of or attached to the case structure of the instrument. Pivot pin 16 extends upwardly from rail 10 and receives pivot bearing 18 having a port 20 substantially of a cross-section equal to the pivot pin.

Key lever 22 having a triangular slot 24 is similarly disposed over pin 16 and rests on pivot bearing 18 which defines a fulcrum point about which the key lever rotates. When the key lever is depressed on the left side, the right side rises to actuate a hammer mechanism which strikes a string to produce a musical note.

FIG. 1*b* shows the apparatus without the key in place and FIG. 1*c* illustrates the two major types of pivot bearings currently in use, a half round felt covered wood bearing 18 having port 20 and a flat washer like felt disc 26 having port 28.

Figure 2A:
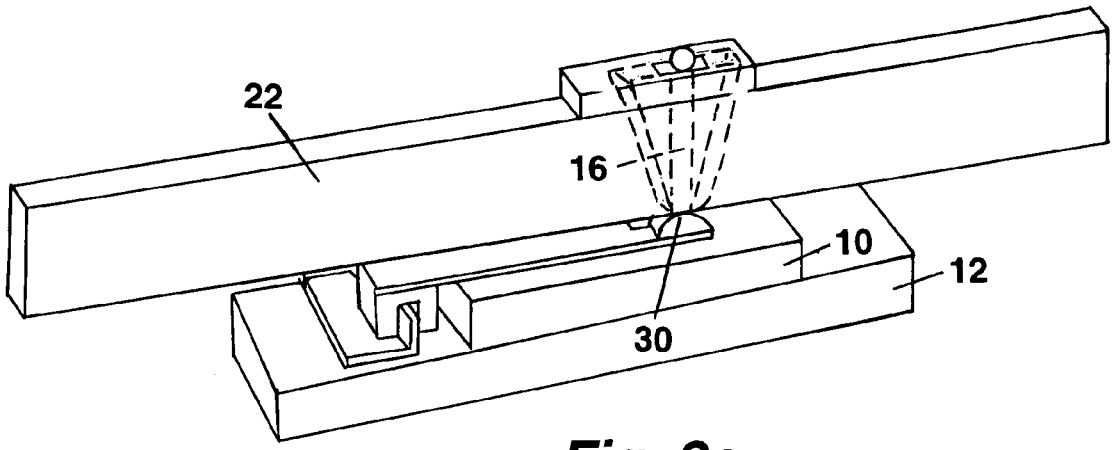
FIGS. 2*a*, 2*b*, and 2*c* are perspective views of the preferred embodiment of the invention.
Figure 2B:
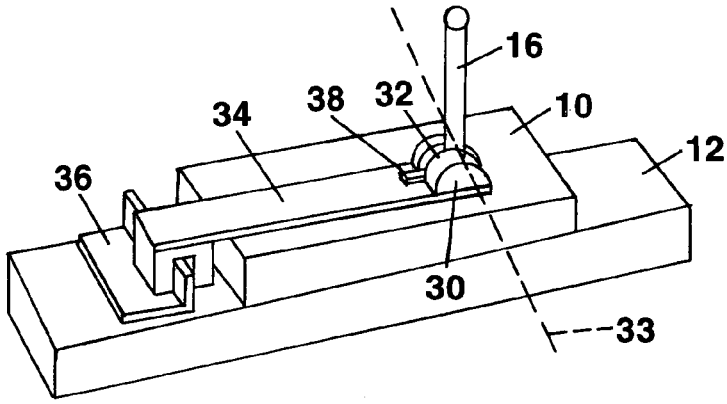
Figure 2C:
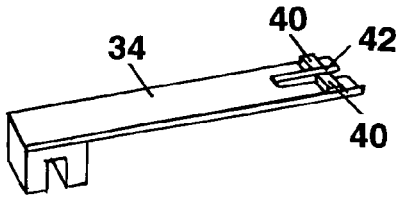

FIGS. 2*a*, 2*b*, and 2*c* are perspective views of the preferred embodiment of the invention as compared to the prior art shown in FIGS. 1*a*, 1*b*, and 1*c* above. Balance rail 10, key frame 12, pivot pin 16, and key lever 22 remain the same while pivot bearing 18 has been replaced by longitudinally slideable pivot bearing 30 having a longitudinal slot 32 about the width of pivot pin 16 but of a length at least the amount of the desired range of displacement of key lever fulcrum point 33 provided by bearing 30.

Means to secure bearing 30 in a chosen longitudinal position are provided by, for example, slideable pivot bearing arm 34 attached to slideable bearing rail 36 which is disposed transverse the instrument and substantially parallel to the keyboard to engage as many of the keys as it is desired to apply the invention to; for example, either all of the keys or groups representing the high, middle, and low notes.

As shown in FIG. 2*b*, the slideable bearing assembly is illustrated with key lever 22 removed. Bearing arm 34 has a longitudinal slot 38 coincident with pivot bearing slot 32 with pivot bearing 3*o* mounted atop the arm. Other means might be used to move or hold the pivot bearing of the invention in place including, for example, brackets for holding each bearing to the bearing rail for a system in which the touch for each key or group of keys is semi-permanently or permanently set for an individual musician.

FIG. 2*c* illustrates an alternative pivot bearing of the invention wherein the bearing is composed of a pair of flat felt rectangles 40 mounted on arm 34 in a spaced apart relationship. As with bearing 30 described above, the separated pair define a slot 42 coincident with slot 36 of the arm.

Figure 3A:
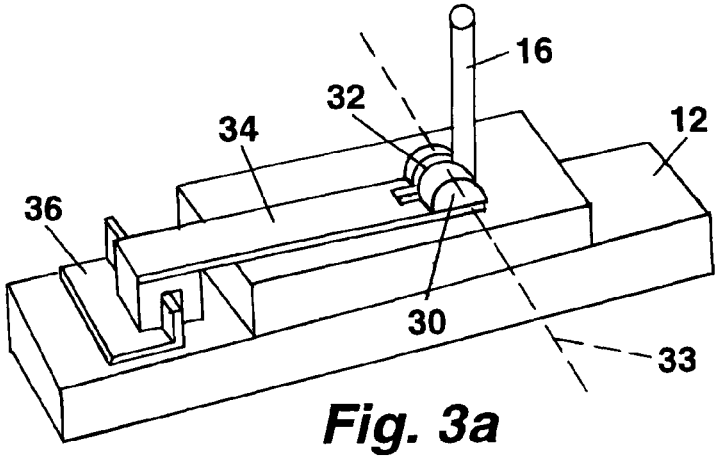
FIGS. 3*a*, 3*b*, and 3*c* are additional perspective views of the preferred embodiment of the invention showing the effect of the apparatus in a keyboard instrument.
Figure 3B:
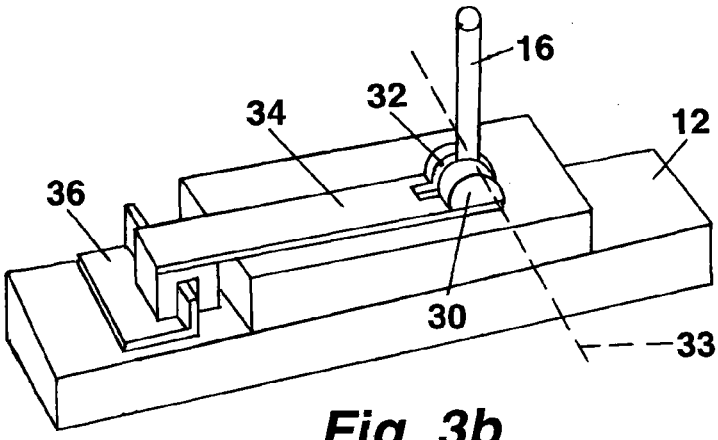
Figure 3C:
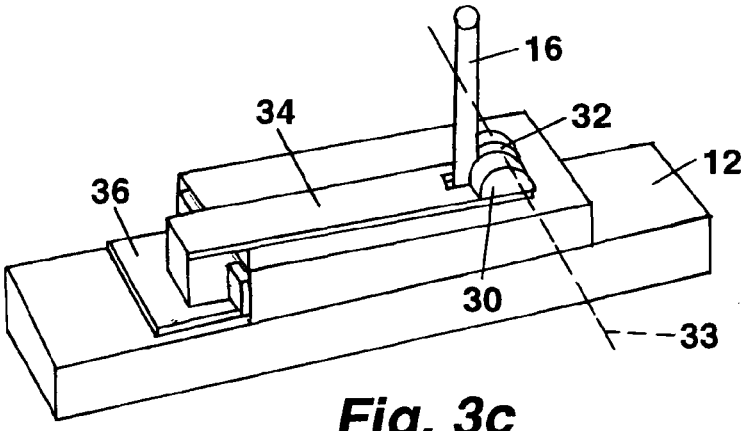

Referring next to FIGS. 3*a*, 3*b*, and 3*c*, the effect of the invention is shown in relation to a key lever actuated by an instrument player to the left or proximal side of the keyboard. FIG. 3*a* shows the pivot bearing and fulcrum point shifted toward the player making the effective lever arm of the key shorter requiring more pressure to strike a note. FIG. 3*b* shows the bearing in a central position as would be the case for prior art static or fixed bearing construction, and FIG. 3*c* shows the bearing moved fully rearward to the distal position creating a longer effective key lever arm resulting in a lighter touch.

Figure 4:
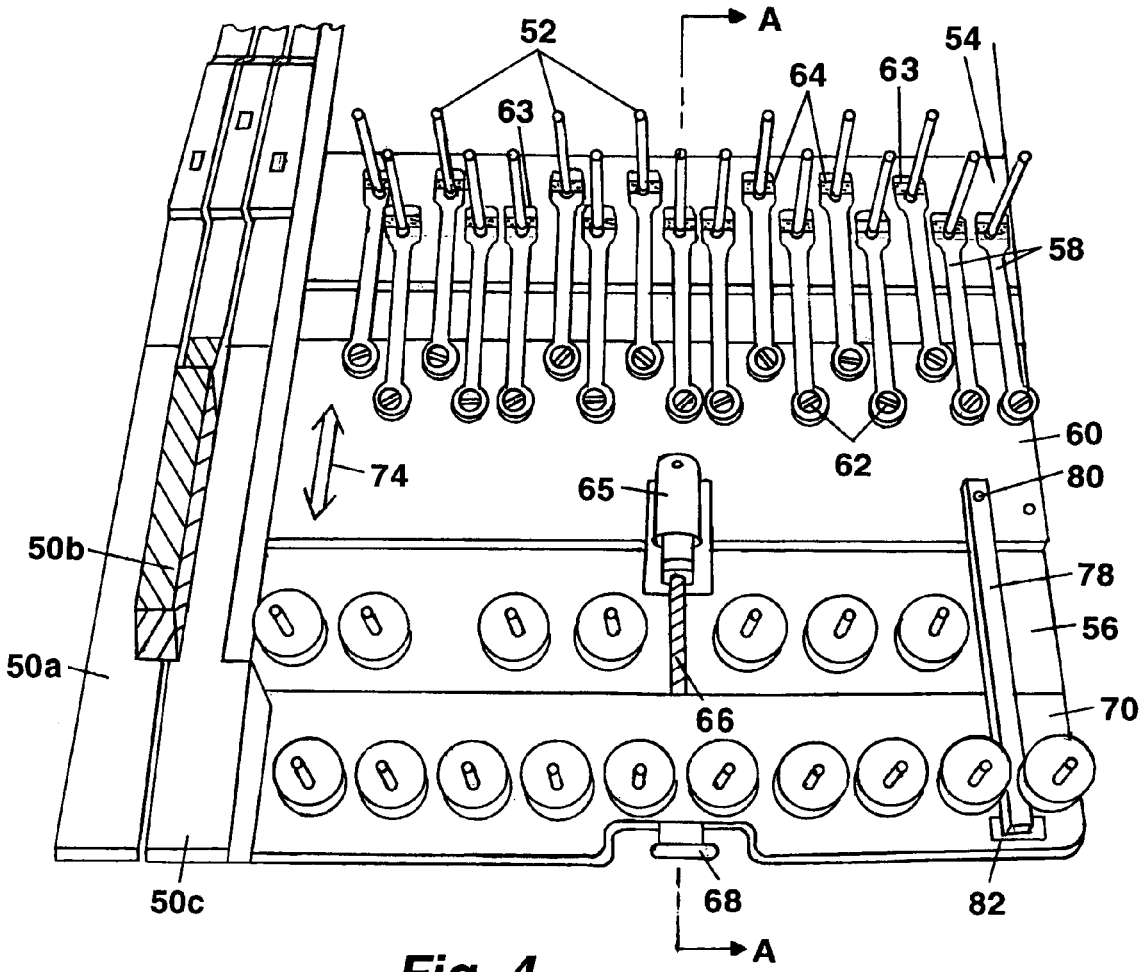
FIG. 4 is a perspective view of an alternative structure of the preferred embodiment of the invention installed in a keyboard instrument.

FIG. 4 is a perspective view of the invention installed in a piano looking forward from the proximal keyboard position. Three key levers 50*a*, 50*b*, and 50*c* are shown installed over pivot pins 52 mounted on balance rail 54 which is in turn mounted on key frame 56. The remainder of the keys are not shown. A plurality of slideable bearing arms 58 are mounted on moveable bearing rail 60 each secured by a screw 62. Arms 58 extend to bracket pivot pins 52 and each has mounted thereon a slotted pivot bearing 63 consisting of spaced apart pivot bearing members 64 as illustrated, for example, in FIG. 2*c* above. Along the length of bearing arm 58, the width outside the area of the slot and pivot bearings is narrowed to allow for clearance between adjacent bearing arms.

Bearing rail 60 is arranged to be moved forward or back so that all the pivot bearings supported by the bearing arms under the key levers may be moved forward or back as a group. A preferred device for pushing or pulling the bearing rail back and forth is the use of threaded nuts 65 attached to the rail, one on each end of the rail one of which is shown. A bolt 66 with a knurled knob 68 is mounted in the instrument case in the front rail 70 of the keyboard and held in place by thrust bearings 72. To move the rail longitudinally, in or out (arrow 74), the knobs are turned in either direction to move the bearing rail, bearing arms, and pivot bearings forward and rearward thereby changing the playing characteristic of the piano.

Rail 60 may be moved in or out equally from each end of the bearing rail 60 to effect an equal change across the keyboard or unequally causing a skewing of the rail and a varying change of the playing characteristic across the keyboard. That is, if one end or the other is moved more or less than the opposite end, the touch will be greater or lighter on one end or the other as the case may be.

Figure 5:
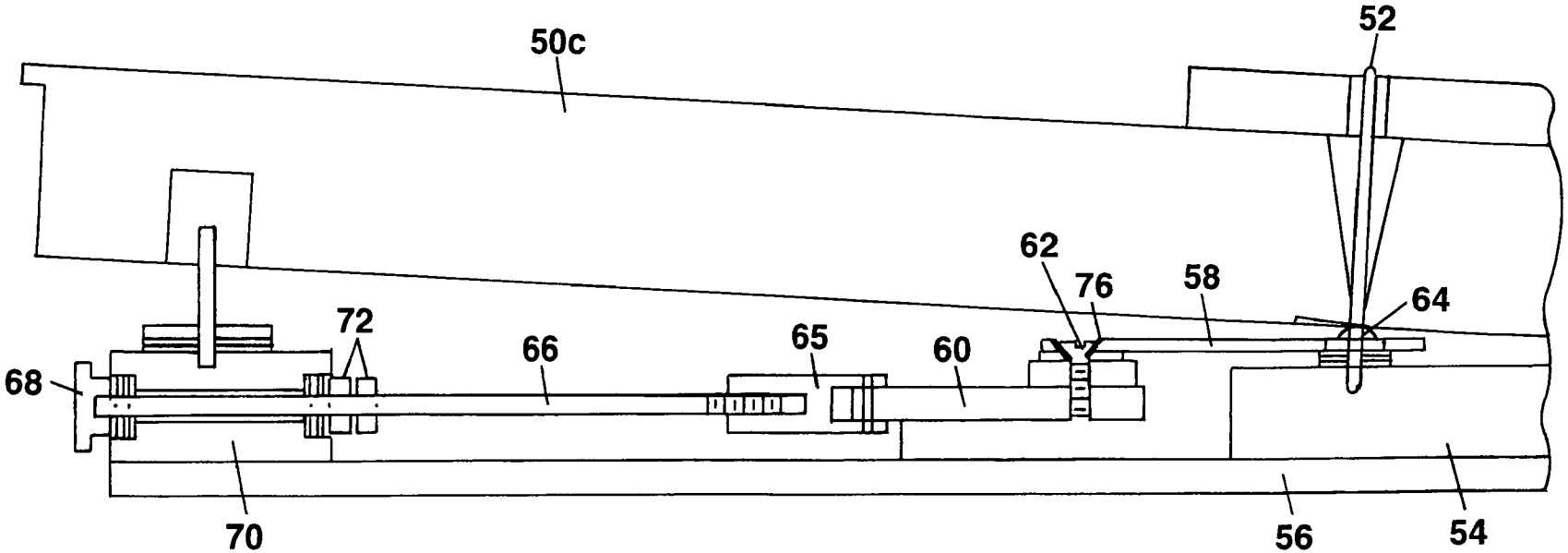
FIG. 5 is a cross-sectional side view of the embodiment of FIG. 4.

FIG. 5 presents a cross-sectional view of the installation of FIG. 4 additionally showing the use of paper punchings 61 under the proximal end of a key lever and 63 at the distal end underneath the pivot bearings and pivot bearing arms. These punchings are a standard device for final adjustments of the key lever action in currently manufactured instruments.

To allow for the skewing of the bearing rail the attachment points 62 of the bearing arms to the bearing rail must allow for horizontal rotation of the bearing arms. This may be accomplished by the disposition of a disk or washer 76 composed of a compressible material such as felt between screw 62 and rail 60. The screw may then be tightened a selected amount to provide a sufficient amount of friction and sound dampening and yet allow bearing arm 58 to adjust to the rearranged position of the apparatus.

Figure 6:
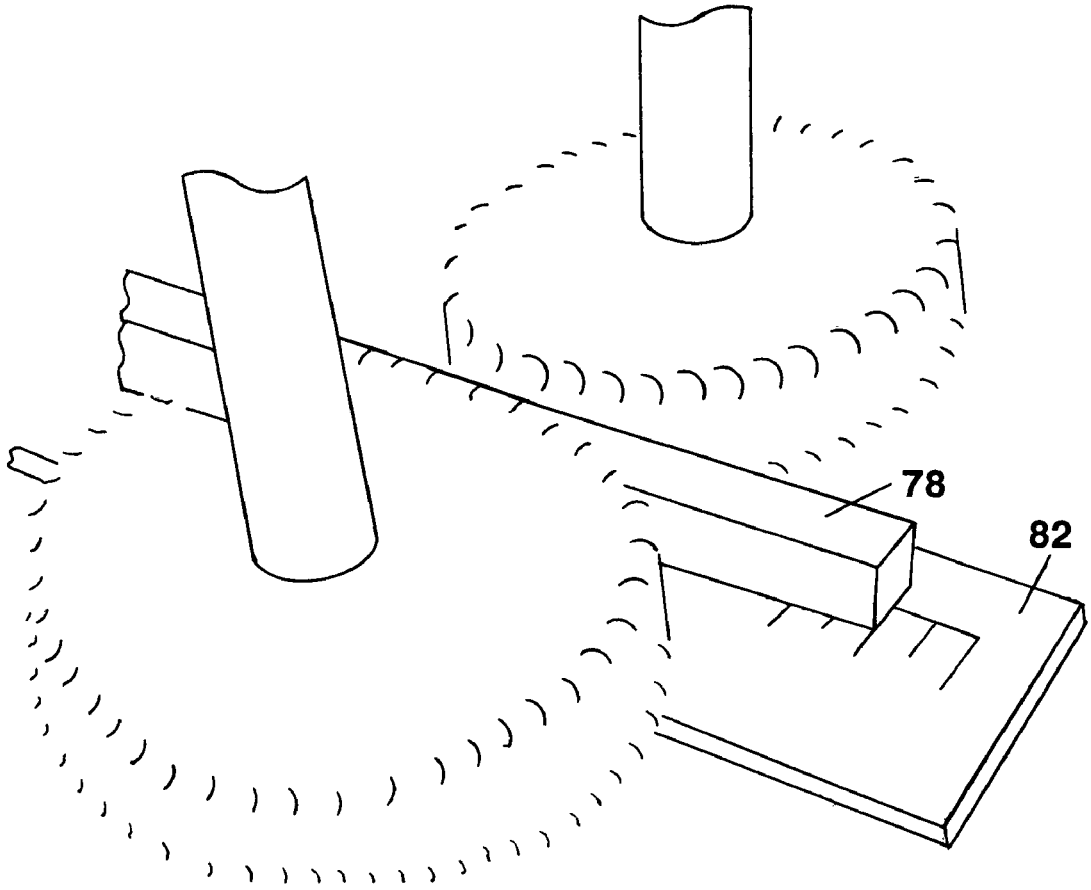
FIG. 6 is perspective view of a portion of FIG. 6.

A bearing rail position indicator arm 78 may be provided on one or both sides of the keyboard so that the player may note the location of the rail for a desired key touch characteristic. Indicator arms 78 may be composed of a thin strip of metal or other stiff material and are attached to bearing rail 60 in a manner that allows them to rotate horizontally by, for example, a screw and washer combination 80 similar to that described above for pivot bearing arms 58. As shown, indicator arms 78 run forward towards the player and rest on the front rail 70 of the keyboard. FIG. 6 illustrates a small scale 82 for indicating the position of the bearing rail so that the player may know the position of the pivot bearings for repeat settings.

It will be appreciated that other various methods for moving the bearing rail back and forth may be provided such as the use of levers for example.

In the current art of making pianos the front or proximal end of the piano key must move downward a precise distance when played. If the distance is too short, the internal workings of the piano key mechanism will not fully complete their function and the key will not strike or play properly. If the proximal end of the piano key moves downward over a greater distance than is needed the piano will be more difficult to play. Thus to alter, that is, either increase or decrease leveraging of the piano key, the specific distance that the front end of the key must travel downwards to allow for the best function of the mechanism must be made greater or lesser.

By repositioning bearing points, the leverage of the key is changed, therefore the requirement for a specific depth of key movement changes. When the leverage is changed by moving the bearing rail and consequently the pivot bearings and fulcrum points, it is desirable to provide a method to compensate for changes in the distance that the key needs to move down at the proximal end when played.

An important aspect of the invention therefore involves the adjustment of each key mechanism throughout the range of adjustment of the pivot bearings. In an instrument of current manufacture with fixed positions of key lever pivot bearings, the key is set to travel a specific distance downward before coming to stop against the front rail. This distance is set very accurately using paper punchings 61 of similar design to the balance rail punchings 63 but of larger diameter. If the position of the fulcrum point is changed, the speed of the hammer is changed in relation to the speed of the key stroke. If the fulcrum point is moved forward, towards the piano player, the hammer moves faster in relation to the front of the key. In this case the distance that the key travels down to its stopping point should be reduced slightly for optimum performance. Conversely if the fulcrum point is moved back, away from the piano player, the hammer moves slower in relation to the front of the key. In this case the distance that the key travels down to its stopping point must be increased slightly for optimum performance.

This optimization may be addressed by setting the angle between the balance rail and the bottom of the key lever to a specific angle when the key is at rest. This of course requires that the surface over which the pivot bearings slide on the balance rail be flat and smooth. This angle, a compensating angle, is arranged such that when the pivot bearings are slid back, a wedge effect causes the key to be pushed up slightly thereby raising the level of the key lever at the front of the keyboard and allowing the necessary distance of travel at the front of the key lever to be increased. This compensating angle is specific to each particular key mechanism design and must be set at a specific compensating angle in order for the keyboard mechanism to stay in adjustment no matter what the position of the pivot bearings under the key.

Figure 7A:
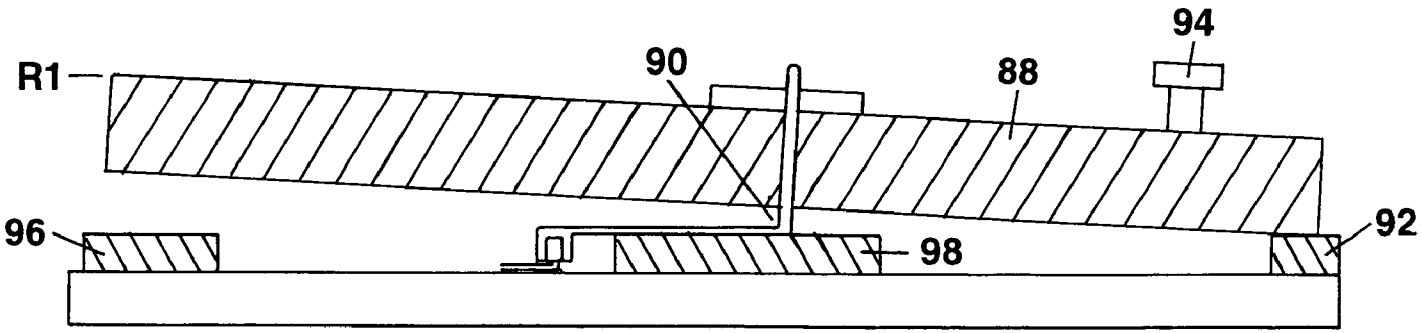
FIGS. 7*a* and 7*b* are diagrammatic representations of a further aspect of the invention.
Figure 7B:
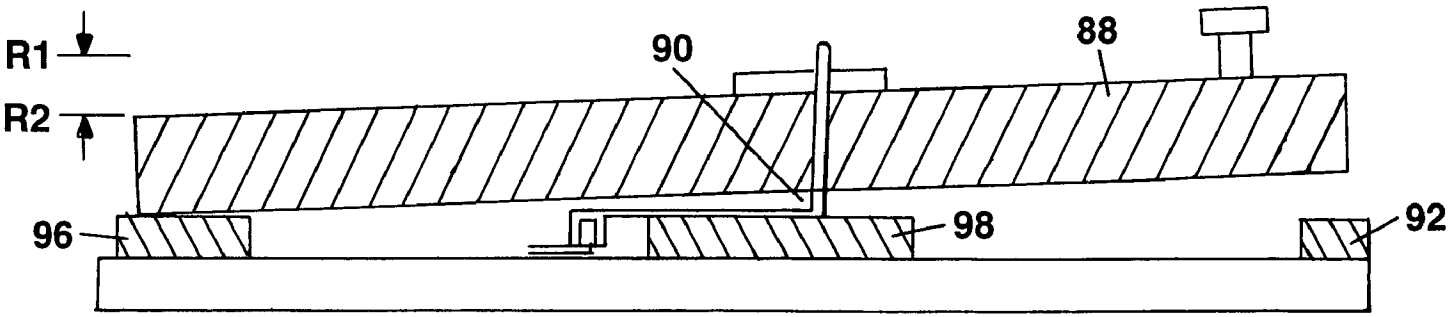

Referring now to FIG. 7*a* there is shown a side view of a key lever 88 with the proximal or playing end on the left side, the moveable pivot bearing 90 near the center, and the key lever resting on pad 92 on the right or distal side. An extension arm 94 on the distal side of the key, engages with an hammer mechanism which strikes the string to make a musical sound. The distance over which the key travels down when played is set by adjusting the thickness of the stopping pad 96. As shown in FIG. 7*b*, the distance that the key travels downward when played is determined by taking a reference point at the top of the key R1 with the key at rest and a reference point R2 with the key depressed against stopping pad 96. The distance of travel is found as R1-R2 and is referred to as dip.

In FIGS. 7*a* and 7*b* the moveable bearing 90 is set to an extreme proximal position thereby creating a heavier feeling to the keys when played.

Figure 8A:
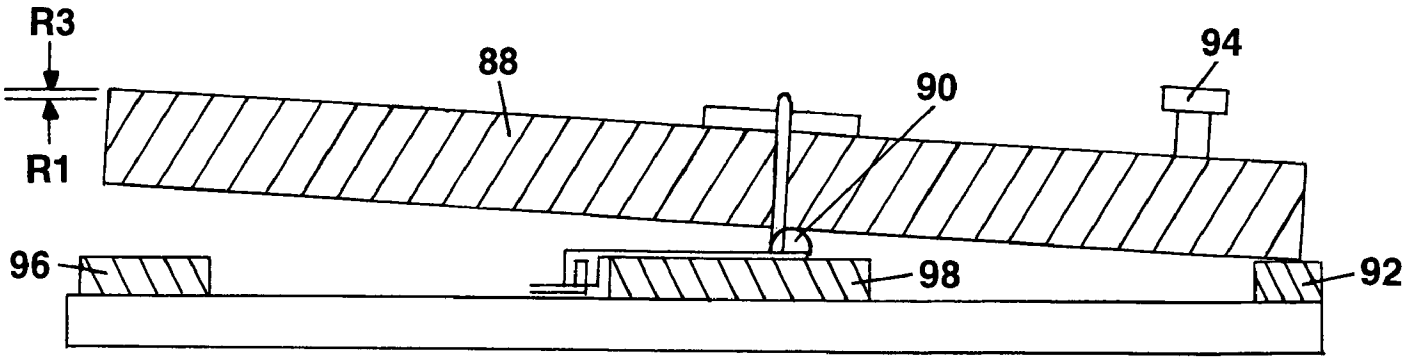
FIGS. 8*a* and 8*b* are additional diagrammatic representations of the further aspect of the invention.
Figure 8B:
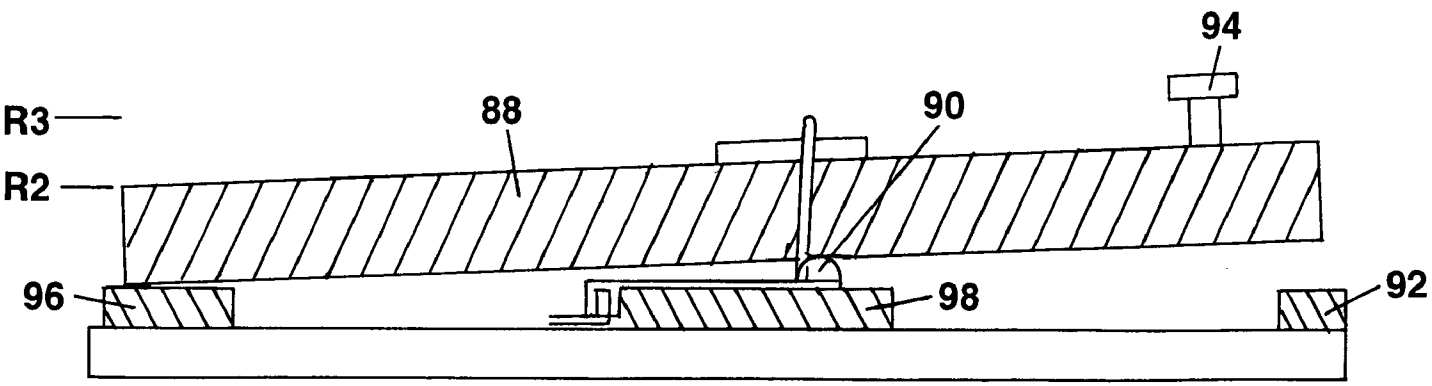

Referring next to FIG. 8, moveable pivot bearing 90 is set to an extreme distal position thereby creating a lighter feeling to the keys when played. With the moveable bearing in this position a deeper dip is required. This is accomplished by setting the angle between the bottom surface of key lever and the balance rail 98 such that when the bearing is moved to the extreme distal position the distance between the key lever and the balance rail becomes smaller. This causes the elevation of the key R1 to be raised higher to point R3. This increases the dip to equal R3−R2 and makes the action functional with the bearing in the extreme distal position.

Figure 9:
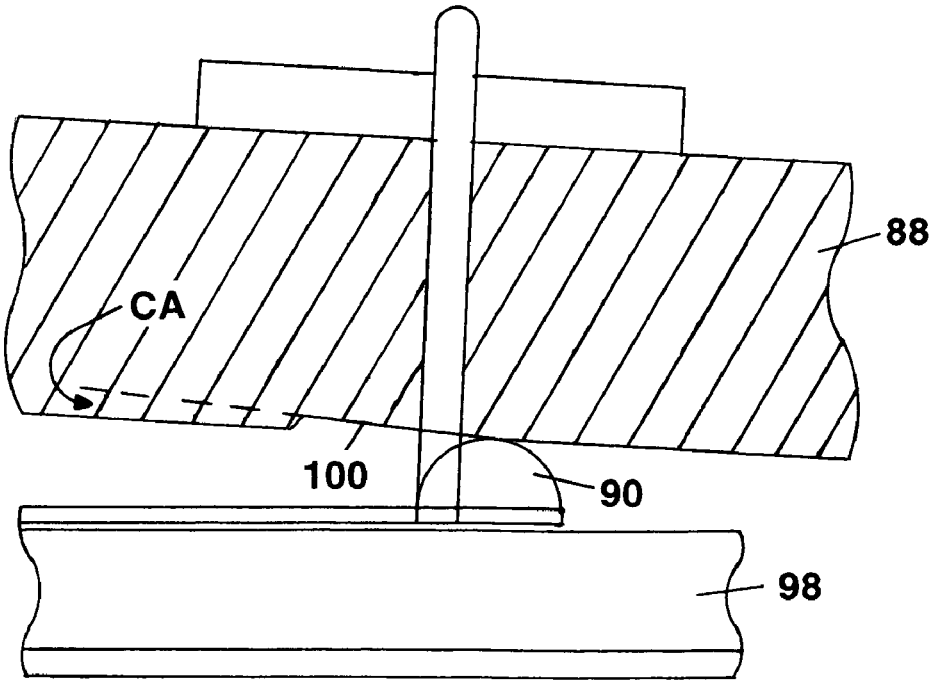
FIG. 9 is an additional diagrammatic representation of the further aspect of the invention.

The particular critical angle between the key lever 88 and the balance rail 98, the compensating angle, is unique for any particular design of stringed keyboard instrument, and differs from the angle normally found between the key lever and balance rail in currently manufactured stringed keyboard instruments such as pianos. In order to satisfy the requirements of dip between the proximal and distal bearing positions, the angle between the key lever and the balance rail needs to be set to satisfy this requirement. This may be done by, for example, such solutions as modifying the underside of key lever 88 with an angle cut 100 as shown in FIG. 9 or by altering the angle of the top surface of balance rail 98 relative to the underside of key lever 98, or by adding shims to the bottom surface of the key lever.

Figure 10:
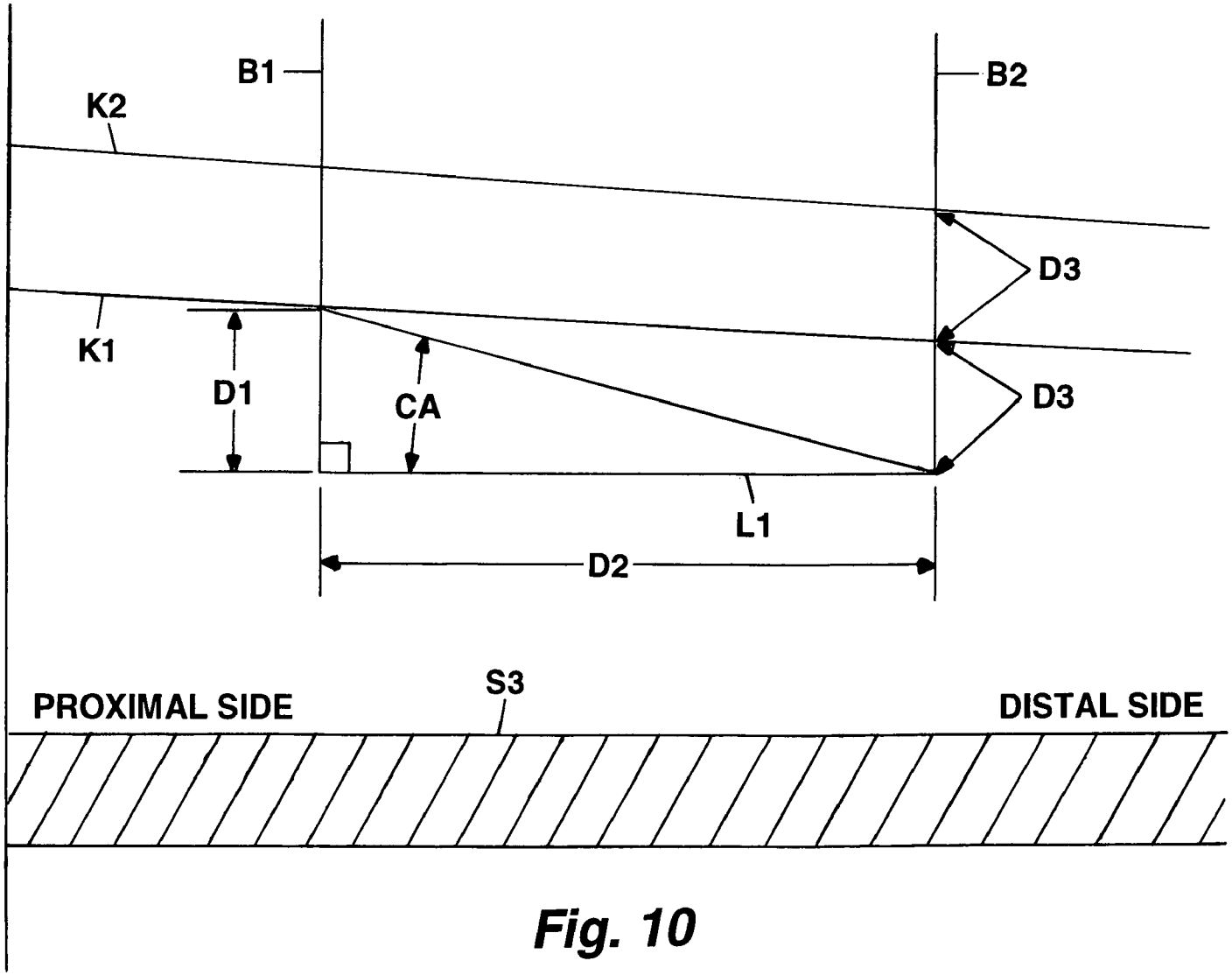
FIG. 10 is an additional diagrammatic representation of the further aspect of the invention.

Therefore, the compensating angle may be found with reference to FIG. 10 as follows:

As the tangent of the compensating angle is D1/D2, the compensating angle may be found by referring to a tangent table.

Where:

B1 is a vertical line through the fulcrum point of the key lever in the proximal or heavy position, B2 is a vertical line through the fulcrum point of the key lever in the distal or light position, K1 is the bottom surface of the key lever with the fulcrum point set to heavy, with the dip set ideally for that leverage, K2 is the bottom surface of the key lever with the fulcrum point set to light, with the key elevated so that the dip is ideal for that leverage, S3 is the top edge of the balance rail, D3 is the distance that the bearing needs to push the key up with the bearing point set in the light position, L1 is a line parallel with the surface of the balance rail S3, and CA is the compensating angle.

As variations in the above described preferred embodiment may be made within the general concept of the disclosure, the invention is accordingly defined by the following claims.

What is claimed is:

1. In a keyboard instrument having a case, a balance rail mounted within said case, a plurality of pivot pins vertically disposed along said rail, and a plurality of key levers each having a slot for receiving one of said pivot pins, said key levers disposed over said pivot pins through said slots, the improvement which comprises:

A. a plurality of movable pivot bearings providing fulcrum points for said levers, each having a longitudinal port for receiving one of said pivot pins, each longitudinally slideably disposed over one of said pivot pins between one of said key levers and said balance rail, wherein the position of each of said pivot bearings is longitudinally adjustable in relation to one of said keys, one of said pivot pins, and said balance rail; and B. pivot bearing adjustment means mounted within said case and attached to said pivot bearings for longitudinally sliding said pivot bearings between said balance rail and said key levers to alter the fulcrum points of said key levers.

2. The improvement of claim 1 wherein said pivot bearing adjustment means comprises:

A. a moveable pivot bearing rail disposed transverse said case substantially aligned with said balance rail;

B. a plurality of pivot bearing arms attached to said pivot bearing, one each of said arms arranged to support one each of said pivot bearings; and C. pivot bearing rail displacement means to longitudinally move said pivot bearing rail in relation to said balance rail to adjust the longitudinal position of said pivot bearings.

3. The improvement of claim 2 wherein said pivot bearing rail displacement means comprises nut means attached to said pivot bearing rail and rotatable bolt means engaged with said nut means mounted on said case.

4. The improvement of claim 3 wherein at least one set of said nut and bolt means are disposed one each at opposite ends of said pivot rail to allow either of said ends to be longitudinally displaced in relation to said balance rail a selected distance.

* * * * *